United States Patent [19]

Flider

[11] 3,953,723

[45] Apr. 27, 1976

[54] PLASTIC CARBIDE LAMP

[75] Inventor: Frank S. Flider, Chicago, Ill.

[73] Assignee: Justrite Manufacturing Company, Chicago, Ill.

[22] Filed: Sept. 8, 1972

[21] Appl. No.: 287,512

Related U.S. Application Data

[63] Continuation of Ser. No. 121,412, March 5, 1971.

[52] U.S. Cl. ..... 240/11.1

[51] Int. Cl.[2] ..... F21V 23/00

[58] Field of Search ..... 240/11.1, 11, 74, 79, 240/82

[56] References Cited

UNITED STATES PATENTS

| | | | |
|---|---|---|---|
| 1,053,516 | 2/1913 | Longstaff et al. | 240/11.1 |
| 1,081,899 | 12/1913 | Evans | 240/11.1 |
| 1,230,892 | 6/1917 | Hansen | 240/11.1 |
| 1,269,047 | 6/1918 | Brock | 240/11.1 |
| 1,666,209 | 4/1928 | Hunt | 240/11.1 |
| 1,775,689 | 9/1930 | Peik | 240/11.1 |

FOREIGN PATENTS OR APPLICATIONS

| | | | |
|---|---|---|---|
| 324,864 | 9/1920 | Germany | 240/11.1 |
| 184,534 | 1/1956 | Germany | 240/11.1 |
| 15,225 | 11/1914 | United Kingdom | 240/11.1 |

*Primary Examiner*—L. T. Hix
*Assistant Examiner*—Robert P. Greiner
*Attorney, Agent, or Firm*—Alter and Weiss

[57] ABSTRACT

A plastic carbide lamp includes upper and lower containers or housings with a water control needle valve therebetween. As the needle valve opens, water drips from the upper container upon calcium carbide in the lower container, to generate acetylene gas. The acetylene gas rises into a dome shaped collection chamber having a burner tip therein, at which the acetylene gas burns.

6 Claims, 7 Drawing Figures

INVENTOR
FRANK S. FLIDER

BY
Alter, Weiss and Whitesel
ATTORNEYS

INVENTOR
FRANK S. FLIDER

BY
Alter, Weiss and Whitesel
ATTORNEYS

PLASTIC CARBIDE LAMP

This is a continuation of application Ser. No. 121,412, filed Mar. 5, 1971.

This invention relates to carbide lamps and more particularly to low cost plastic carbide lamps.

Carbide lamps have been known for a long time. However, in recent times, there have been very little basic improvements in these lamps. Among other things, this lack of further development is because the existing lamp design was very well thought out, and almost no further development was required. The further development of the lamp has practically stood still, and the lamps have become "old fashioned", while competitive forms of lamps have been developed using newer production techniques. As a result, these newer lamps are often viewed as more "modern", more convenient, or lower cost than the carbide lamps, which is not always true.

This is unfortunate since, in principle, carbide lamps have certain specially attractive features and characteristics and there is no completely suitable substitute for them. Thus, there is a need for a modernization of the carbide lamp design, which modernization will both improve performance, enhance appearances, and reduce costs.

Accordingly, an object of this invention is to provide new and improved carbide lamps. In particular, an object is to provide such carbide lamps which can be manufactured at low cost on modern production tooling. Here, an object is to provide lamps which are free of the need for substantial amounts of hand labor during manufacture.

Another object of the invention is to provide a carbide lamp having a modern appearance. In this connection, an object is to provide a design which may be altered at low cost to maintain a modern appearance, as styles change.

Still another object is to provide an all plastic carbide lamp which meets all safety requirements of both government and industry.

In keeping with an aspect of the invention, these and other objects are accomplished by a lamp having upper and lower plastic housings or containers which are attached to each other by screw threads and sealed together by a rubber collar or gasket. The upper container is a water shell which has a needle valve or water control shaft for controlling a flow rate at which water drips into the lower or carbide container. The lower or carbide includes a gas collecting dome into which acetylene gas rises. A burner cap or flame tip is attached to the dome for burning the gas.

The nature of a preferred embodiment of the invention for accomplishing these and other objects may be understood best from a study of the following description and the attached drawing in which.

Figure 1:
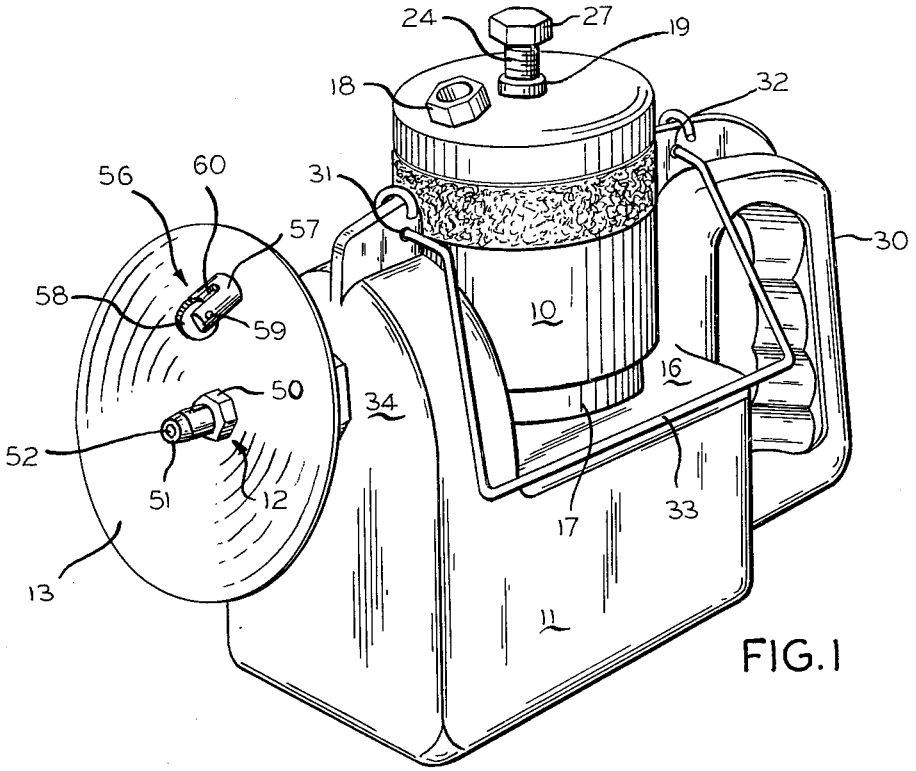
FIG. 1 is a perspective view of the inventive lamp.

The major sub-assemblies of the inventive lamp are an upper chamber or water shell 10, a lower chamber or calcium carbide container 11, a burner cap and flame tip 12, and a reflector 13. The upper chamber or water shell 10 is removably attached to the lower chamber or carbide container 11 by means of screw threads 15 at a central platform area 16. A rubber gasket 17 is compressed between upper and lower containers 10, 11, as these containers are brought together on the screw threads 15.

Figure 3:
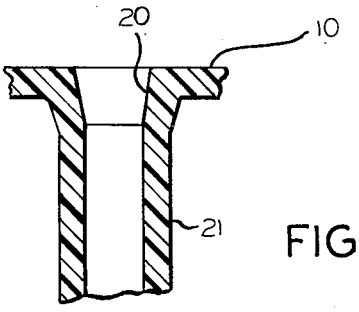
Fig. 3 is a cross-sectional view of the valve seat.
Figure 4:
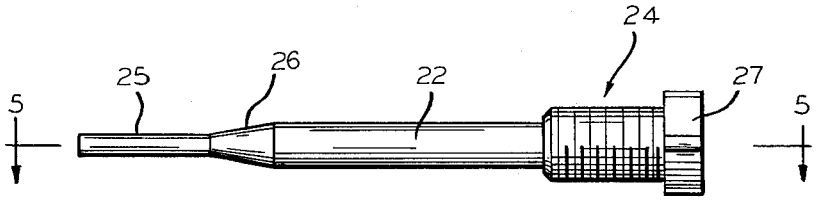
FIG. 4 is a side elevation view of the water control shaft or needle valve.

The upper container or water shell 10 comprises a hollow chamber having two openings 18, 19 (at the top) and a valve seat 20 with an integral dependent tube 21 (at the bottom). The opening 18 is closed by a screw cap and provides an entry for filling the water shell 10 with water. The opening 19 is internally threaded to receive a water control shaft or needle valve 22, which is threaded at one end 24. The other end of the water control shaft includes a portion 25 of reduced diameter for loosely sliding through the dependent tube 21. The water control shaft or needle valve 22 terminates at one end in a knob 27 and on the other end in a conical section 26, which seals itself against the seat 20 when the valve is closed. From an inspection of FIGS. 3 and 4, it is seen that the seat 20 has a conical taper which exactly matches and mates with the taper of section 26 on the needle valve.

Figure 5:
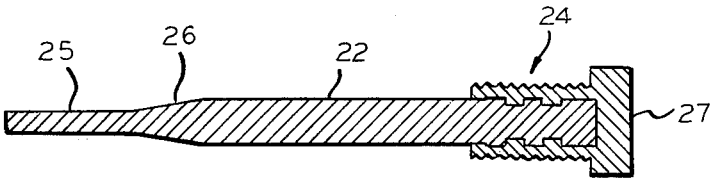
FIG. 5 is a cross-sectional view, taken along line 5—5 of FIG. 4, of a partly plastic water control shaft or needle valve.

FIG. 5 shows a low cost, water control, valve assembly wherein the shaft 22 is a metal, such as brass, and the knob or cap 27 is a plastic material molded thereto. The top of the knob or cap 27 may have suitable operating instructions molded or otherwise formed therein.

It should now be apparent that, as the knob 27 is turned, the tapered section 26 of the needle valve is raised out of or lowered into the seat 20. Therefore, the flow of water out of the upper chamber or water shell varies directly with the number of times that the knob 27 is turned.

The lower chamber or carbide compartment 11 includes a handle 30 integrally formed on one side of the platform area 16, a pair of eyelets 31, 32 for receiving the ends of a handle or bail 33 (FIG. 1), and an acetylene gas collecting dome section 34 on the other side of the platform area 16.

The dome 34 terminates in a threaded horizontally oriented opening 35 facing the front of the lamp. The upper part of the dome 34 includes a filter 36 which may be a suitable packing for preventing any small particles from blocking the tip (for example, dense foam is such a suitable packing material).

Threadably seated on opening 35 is a burner cap 40 which is sealed in place by a rubber O-ring 41. The cap 40 may, in part, be made from a plastic material (FIGS. 6,7); or, it may be made in its entirety from metal (FIG. 2), preferably as a so-called screw machine part.

Figure 2:
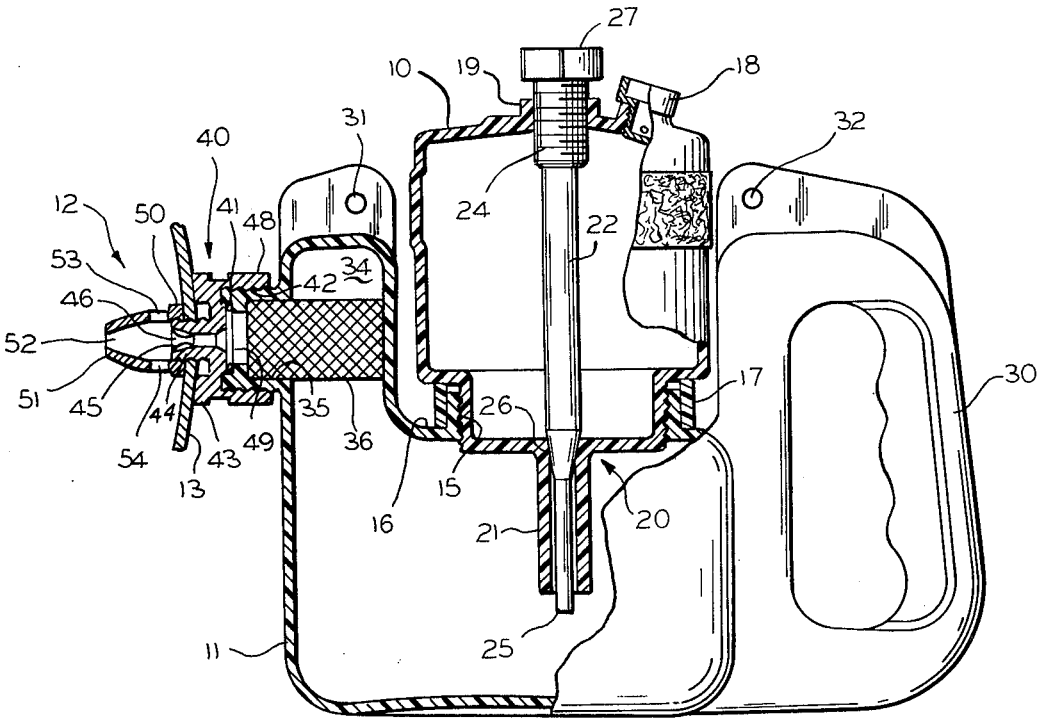
FIG. 2 is a side elevation view, partly in cross-section, showing the carbide lamp elements.
Figure 6:
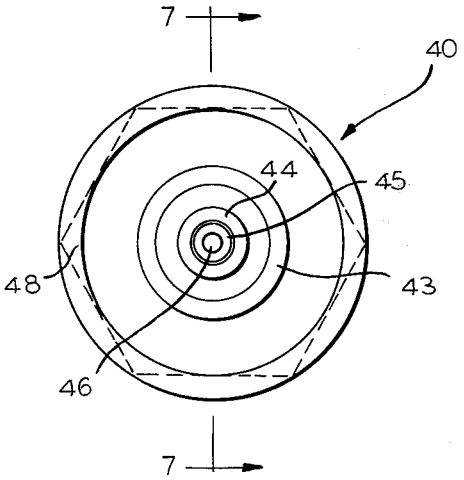
FIG. 6 is a plan view of the burner cap and flame tip.
Figure 7:
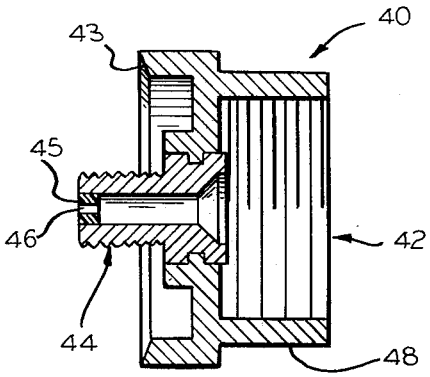
FIG. 7 is a cross-sectional view of the burner cap and flame tip taken along line 7—7 of FIG. 6.

In greater detail, one portion of the burner cap 40 is a generally cylindrical sleeve terminating at one end in a threaded nut-like section (FIG. 7) which fits over the threads on opening 35 (FIG. 2). At the other end, cap 40 has a rim 43 which forms a seat for the reflector 13. When the plastic and metal structure of FIGS. 6 and 7 is used, a flame proof sleeve, such as a threaded metal tube 44, is molded into the end of the plastic piecepart 40. Crimped inside the tube 44 is a flame resistant bead, such as a ceramic bead 45, having a fine hole 46 therein for allowing passage of the acetylene gas from inside the dome 34 to the atmosphere. There is a hexagon shaped head 48 beneath the rim 43 to facilitate attachment and removal of the burner tip.

When the burner cap 40 is made entirely from metal, the structure is the same, except that the cap 40 and the tube 44 are a single and unitary piece of metal, as shown in FIG. 2.

The invention also contemplates a use of a filter comprising a felt disk and a wire screen 49, which fits into the opening 42 and inside the O-ring 41. The felt packing disk serves as a filter to prevent small particles from blocking the tip 46. It should be periodically removed, washed and dried to remove any residue. The dry disk is then replaced in the lamp. The disk should be completely replaced when worn.

The assembly is completed when the reflector 13 (FIG. 2) is placed over the threaded tube 44 and a locknut 50 is turned onto the threads of the tube. A hollow, dome shaped, flame guard 51 is integrally associated with the locknut 50. The tip 52 of guard 51 is open to allow passage of the burning flame of acetylene gas. At least one, and preferably two openings 53, 54, allow oxygen to enter the flame guard.

Also mounted on the reflector 13, near the burner cap 40 and flame tip 12 is a flint and steel igniter 56 somewhat similar to the flint and steel igniter of a cigarette lighter. More particularly, this assembly comprises an upstanding bifurcated post 57 having a knurled steel wheel 58 rotatably supported on an axle 59. A flint 60 is fed outwardly (as viewed in FIG. 1), under spring tension (not shown) to engage the knurled surface of the wheel 58. The flints are replaced by removal of a cap (not seen in FIG. 1) on the opposite side of the reflector 13.

In operation, the first step is to place enough carbide (preferably one-half inch size) in the bottom chamber 11 to fill it about one-third of the way full. This much carbide leaves adequate room in the chamber 11 for expansion of the by-product acetylene gas. Use of any more carbide would likely result in poor lamp performance. This charge should last about 2 and ½ hours in a typical lamp.

The second step is to fill the water chamber with clean water. Use of muddy water would likely result in dirt particles clogging the water feeding system. Then, the water control knob 27 is adjusted to allow approximately one drop of water to flow about every 3 seconds. This flow rate should produce a flame about 1 inch in length.

After the lower chamber 11 is properly filled with the specified amount of carbide, the upper water shell chamber is filled with water, and the drip rate is adjusted. The upper and lower chambers 11 are screwed snugly into place so that no gas escapes around the gasket 17.

In the lower carbide chamber 11 of the lamp, acetylene gas is produced by the controlled mixing of calcium carbide and water. The gas rises through the filter 36 and passes through the felt packing disk 49 and out the burner tip 46. Inside the flame dome 51, the gas mixes with oxygen in the air. If the spark is introduced into this mixture, a white flame results.

The third step is to allow the acetylene gas to accumulate for about one-half minute. Then the user cups his hand over the top one-half of the reflector 13 to form a pocket for accumulating the acetylene gas. After a few seconds, the flint wheel 58 is rolled with a snapping motion to generate a spark and ignite the gas.

Conveniently, this may be done with a downward motion of the hand across the lighter wheel. The acetylene gas should ignite with a small "pop".

The fourth and final step is to adjust the water control knob 27 so that the flame is about one inch long, for general use. If there is a fire hazzard in the ambient surrounding environment, such as in dry bush, the flame is made shorter. The flame may be larger if the user is walking in, say, a large cave passage or in the open. The light produced by this flame is directed by the reflector 13.

After each use, all water and carbide are removed from the chambers 10, 11. A failure to remove the carbide results in its forming a very hard deposit in the chamber 11. The removal of the water is accomplished by a full opening of the water control needle valve 27 to let the water run through and flush the water feeding system.

Except for the felt and screen filter 49, needle valve shaft 22, burner tip 44, 45, reflector 13, and igniter 56, all parts of the lamp are made from a high density, linear, polyethylene. Preferably, the housing parts 10, 11 are made by a blow molding process. The caps 18 and 40 and knob may be made in an injection molding process. The bail 33 may be either plastic or wire, depending upon the manufacturer's preferences.

Other and further modifications may readily occur to those who are skilled in the art. Therefore, the appended claims are to be construed to cover all equivalent structures which may fall within the spirit and the scope of the invention.

I claim:

1. A carbide lamp assembly, said assembly comprising a plastic container for retaining carbide therein, a plastic water shell for storing water therein, said plastic container having a generally closed smooth wall tank member, a centrally located platform member on said tank member, an integral upstanding internally threaded collar vertically disposed on said platform member, said water shell having an exernally threaded section integral thereto mating with the internally threaded upstanding collar, a centrally located hollow tube downwardly dependent from said externally threaded section, said hollow tube terminating at its upper end in a tapered seat, water flow control means resting in said tapered seat and extending through the top of said water shell for external control of the water flow, a gas collecting dome section positioned near the periphery of said tank member spaced away from and rising above the level of the rest of the tank member, and burner means connected directly to said dome section whereby gas collects therein and tubing is not required to bring gas to said burner means, a vertical handle is integrally mounted on one of said tank member, an upstanding horizontal fin is integrally formed on the top of said dome and said handle, said handle and upstanding fin being separated from the interior of said tank member, and means for securing a bale to said upstanding fin and said handle.

2. The carbide lamp assembly of claim 1 wherein said dome section terminates in an outwardly extending an horizontally disposed threaded opening integrally formed in said tank member, and wherein said burner means comprises a gas transmitting filter located inside said gas collecting dome adjacent said outwardly extending and horizontally disposed threaded opening, reflector means connected to said outwardly extending and horizontally disposed threaded opening, and a burner cap located over said outwardly extending and horizontally disposed openings for securing said reflector in place and for providing a burning jet orifice.

3. The plastic carbide lamp of claim 2 wherein an annular resilient cylindrical rubber-like gasket fits over said collar to surround and rise above the top of said collar, and said resilient gasket being compressed between the plastic water shell and the plastic container when the water shell is threadably attached to said container.

4. The lamp of claim 2 wherein said burner cap comprises a threaded plastic nut having a flameproof sleeve molded in one side thereof, and said sleeve having a bead crimped therein.

5. The lamp of claim 2 wherein said water flow control means comprises a metal shaft having at one end a reduced diameter section fitting into said tube and a tapered section above said one end and fitting into said tapered seat.

6. The lamp of claim 2 wherein said water flow control means comprises a metal shaft having at one end a reduced diameter section fitting into said dependent tube and a tapered section above said one end and fitting into said tapered seat, and a cap molded onto the other end of said shaft.

* * * * *

UNITED STATES PATENT OFFICE

CERTIFICATE OF CORRECTION

Patent No. 3,953,723 Dated April 27, 1976

Inventor(s) FRANK S. FLIDER

It is certified that error appears in the above-identified patent and that said Letters Patent are hereby corrected as shown below:

Column 1, Line 51 After the word "carbide" insert the word -- container--

Signed and Sealed this

Twenty-third Day of November 1976

[SEAL]

*Attest:*

RUTH C. MASON
*Attesting Officer*

C. MARSHALL DANN
*Commissioner of Patents and Trademarks*